US010737320B2

(12) United States Patent
Li et al.

(10) Patent No.: US 10,737,320 B2
(45) Date of Patent: Aug. 11, 2020

(54) HIGH-PURITY TANTALUM POWDER AND PREPARATION METHOD THEREOF

(71) Applicant: NINGXIA ORIENT TANTALUM INDUSTRY CO., LTD., Ningxia (CN)

(72) Inventors: Zhongxiang Li, Ningxia (CN); Yuewei Cheng, Ningxia (CN); Xueqing Chen, Ningxia (CN); Ting Wang, Ningxia (CN); Dejun Shi, Ningxia (CN); Zekun Tong, Ningxia (CN); Yan Yan, Ningxia (CN); Xiaoyu Tian, Ningxia (CN); Zhonghuan Zhao, Ningxia (CN)

(73) Assignee: Ningxia Orient Tantalum Industry Co., Ltd., Ningxia (CN)

( * ) Notice: Subject to any disclaimer, the term of this patent is extended or adjusted under 35 U.S.C. 154(b) by 986 days.

(21) Appl. No.: 15/111,632

(22) PCT Filed: Feb. 27, 2014

(86) PCT No.: PCT/CN2014/072597

§ 371 (c)(1),
(2) Date: Jul. 14, 2016

(87) PCT Pub. No.: WO2015/127613

PCT Pub. Date: Sep. 3, 2015

(65) Prior Publication Data

US 2016/0354838 A1 Dec. 8, 2016

(51) Int. Cl.

| | |
|---|---|
| ***B22F 1/00*** | (2006.01) |
| ***B22F 9/04*** | (2006.01) |
| ***B22F 9/02*** | (2006.01) |
| ***B22F 9/16*** | (2006.01) |
| ***C22F 1/18*** | (2006.01) |
| ***C23G 1/00*** | (2006.01) |

(52) U.S. Cl.

CPC ..... *B22F 1/0003* (2013.01); *B22F 9/023* (2013.01); *B22F 9/04* (2013.01); *B22F 9/16* (2013.01); *C22F 1/18* (2013.01); *C23G 1/00* (2013.01); *B22F 2009/043* (2013.01); *B22F 2301/20* (2013.01); *B22F 2304/10* (2013.01); *B22F 2998/10* (2013.01)

(58) Field of Classification Search

CPC ..... B22F 1/00; B22F 1/0003; B22F 9/023; B22F 9/04; C22F 1/18; C22F 1/00

USPC ..... 75/255

See application file for complete search history.

(56) References Cited

U.S. PATENT DOCUMENTS

| | | | |
|---|---|---|---|
| 3,295,951 | A † | 1/1967 | Fincham |
| 3,418,106 | A † | 12/1968 | Pierret |
| 4,017,302 | A † | 4/1977 | Bates et al. |
| 4,483,819 | A | 11/1984 | Albrecht et al. |
| 2003/0056619 | A1 | 3/2003 | Kumar et al. |
| 2008/0011124 | A1 | 1/2008 | Loffelholz et al. |
| 2008/0254293 | A1 † | 10/2008 | Loffelholz |
| 2009/0067121 | A1 | 3/2009 | Mizusaki et al. |
| 2009/0095130 | A1 | 4/2009 | Smokovich et al. |

FOREIGN PATENT DOCUMENTS

| | | | |
|---|---|---|---|
| CA | 2352336 | A1 | 6/2000 |
| CN | 101182602 | | 5/2008 |
| CN | 101808770 | | 8/2010 |
| CN | 102120258 | | 7/2011 |
| CN | 102554215 | | 7/2012 |
| CN | 102909365 | | 2/2013 |
| CN | 103447544 | | 12/2013 |
| CN | 103600086 | | 2/2014 |
| JP | 2-310301 | A | 12/1990 |
| JP | 02310301 | A † | 12/1990 |
| JP | 2004-360043 | | 12/2004 |
| JP | 2011-190537 | A | 9/2011 |
| WO | 9961670 | † | 12/1999 |
| WO | 0031310 | † | 6/2000 |
| WO | 0112364 | A1 † | 2/2001 |

OTHER PUBLICATIONS

Office Action dated Aug. 20, 2018 in related EP Patent Application No. 14883916.0, 9 pages.

Notification of Reasons for Refusal Japanese Patent Application No. 2016-554604 dated Sep. 21, 2017 with English translation.

Extended European Search Report EP Application No. 14883916.0 dated Oct. 12, 2017.

International Search Report dated Jul. 2, 2014 for Appln. No. PCT/CN2014/072597.

Chinese Office Action dated Sep. 5, 2016 for Appln. No. 201480016668.3.

International Search Report dated Jul. 29, 2014 for Appln. No.

Office Action dated Jun. 4, 2019 in related Japanese Patent Application No. 2018-090065, 4 pages.

Office Action dated Apr. 11, 2019 in related European Patent Application No. 14883916.0, 4 pages.

Prabhat Kumar and Henning Uhlenhut, Recent Advances in P/M-Tantalum Products, 15th International Plansee Seminar, Eds. G. Kneringer, P. Rödhammer and H. Wildner, Plansee Holding AG, Reutte (2001), vol. 1, pp. 449-453.†

† cited by third party

*Primary Examiner* — Edward M Johnson

(74) *Attorney, Agent, or Firm* — Pillsbury Winthrop Shaw Pittmam LLP

(57) ABSTRACT

The present invention relates to a high-purity tantalum powder and a preparation method therefore. The tantalum powder has a purity of more than 99.995%, as analyzed by GDMS. Preferably, the tantalum powder has an oxygen content of not more than 1000 ppm, a nitrogen content of not more than 50 ppm, a hydrogen content of not more than 20 ppm, a magnesium content of not more than 5 ppm, and an average particle diameter D50 of less than 25 μm.

8 Claims, No Drawings

HIGH-PURITY TANTALUM POWDER AND PREPARATION METHOD THEREOF

CROSS-REFERENCE TO RELATED APPLICATIONS

This is the U.S. National Stage of PCT/CN2014/072597, filed Feb. 27, 2014, the entire contents of which is incorporated herein by reference in its entirety.

TECHNICAL FIELD

The present invention relates to a high purity tantalum powder and a preparation method therefor, More particularly, the tantalum powder has a purity of more than 99.995%, an average particle diameter of D50<25 mm, an oxygen content of not more than 1000 ppm, a nitrogen content of not more than 50 ppm, a hydrogen content of not more than 20 ppm, and a magnesium content of not more than 5 ppm.

BACKGROUND

In recent years, the semiconductor technology is rapidly developed, and the demand quantity for tantalum in sputtered films is gradually increased. In integrated circuits, tantalum, as a diffusion barrier layer, is disposed between a silicon material and a copper conductor Methods for producing a tantalum sputtering target include an ingot metallurgy (I/M) method and a powder metallurgy (P/M) method. A tantalum target which is for less demanding applications is generally prepared from a tantalum ingot. However, in some cases with higher requirements, the I/M method cannot be used, and only the powder metallurgy method can be used for producing these tantalum targets. For example, the I/M method cannot produce a tantalum-silicon alloy target for the reasons of different melting points of tantalum and silicon and a low toughness of silicon compounds.

The performance of target can directly affect the performance of sputtered film. During the formation of the film, substances which can pollute semiconductor devices cannot exist. When the sputtered film is formed, if impurities are present in a tantalum (alloys, compounds) target, the impurities will be introduced into the sputtering chamber. The introduced impurities can lead to the attachment of coarse particles onto no so that short-circuit may occur in the resultant film loop. At the same time, the impurities will become the reason for the increase of projection particles in the film. In particular, impurities, including gaseous oxygen, carbon, hydrogen, and nitrogen, present in the target will be more harmful since they can cause abnormal discharge, and thus there is a defect regarding to the homogeneity of the formed film. In addition, as to the powder metallurgy method, the homogeneity of deposited film is a function of the size of grains in the target. That is, the finer the grain in the target, the more uniform the resultant film. Therefore, there is the need for high quality tantalum powder and tantalum target in existing techniques.

Therefore, in order to obtain high quality tantalum powder and tantalum target, impurities in the tantalum powder should be reduced firstly, so as to increase the purity of the tantalum powder. However, it is well known that although the performance of metal tantalum is relatively stable, metal tantalum powder having a low particle size is more active, and it can be reacted with oxygen, and nitrogen at normal temperature, thereby to increase the contents of oxygen, nitrogen impurities in the tantalum powder. Although some metallic tantalum products, e.g., some commercially available tantalum ingots, can have a purity of up to 99.995%, or even higher, the finer tantalum powder will lead to a higher activity, and its ability to absorb oxygen, nitrogen, hydrogen, carbon is increased accordingly. Hence, as always regarded, it is relatively difficult and hard to increase the purity of tantalum powder to be 99.99% or above, and as even regarded, it is difficult to further reduce one of harmful oxygen, carbon, hydrogen and nitrogen impurities, let alone to reduce the four harmful impurities simultaneously.

Secondly, it is necessary to reduce the particle size of tantalum powder for increasing the quality of tantalum powder and tantalum target. A high purity tantalum powder having an average particle size of D50<25 μm is desired in the art.

Many skilled artisans carry out extensive research to attempt to obtain tantalum powder having a high purity and a low particle size, whereas the resultant results are not ideal.

For example, Chinese patent CN101182602A discloses a medical tantalum powder, characterized in that the oxygen content of the tantalum powder is smaller than or equal to 1500 ppm, and the nitrogen content is lower than 200 ppm. However, the content of metallic impurities and hydrogen in the powder may be high, and the particles are coarse, having a particle size D50 of about 70 μm.

Chinese Patent CN102909365 discloses a medical tantalum powder. The oxygen content of the tantalum powder is smaller than or equal to 1000 ppm, the granularity of 95% of the tantalum powder is 1.0-50.0 μm. However, by way of the simultaneous deoxygenation and dehydrogenation, since low temperature cannot effectively remove hydrogen in the tantalum powder, when the dehydrogenation and the deoxygenation are performed simultaneously, the processing temperature will be high. Moreover, tantalum powder before the deoxygenation and dehydrogenation is not subjected to a high temperature treatment, and thus its activity is higher, so that magnesium or magnesium oxide particles are easily encapsulated in the interior of tantalum particles. Thus, the magnesium or magnesium oxide particles are not easily removed during subsequent pickling process, thereby to result in high magnesium content in final product. Furthermore, in the invention, after the pickling, no heat treatment is conducted, and thus residual metal magnesium after the deoxygenation, and H, F impurities entrained during the pickling in the final tantalum powder cannot be removed. Therefore, with this method, it is difficult to reach the hydrogen content of less than 20 ppm, and the magnesium content of less than 5 ppm. It is reported that the highest purity obtained by this method may be 99.9%.

China Patent CN103447544A discloses a preparation method of particle size distribution concentrated and controllable high-purity tantalum powder, characterized in that the method includes hydrogenating high-purity tantalum ingots into tantalum scraps, subjecting the tantalum scraps to crushing and classification in turn, and then subjecting the classified tantalum powder to a low-temperature vacuum drying and a dehydrogenation treatment in turn, wherein in at least crushing and classification processes, all appliances in contact with the tantalum powder are made of tantalum with a purity more than 99.99%. The disadvantages of the method reside in that: 1. because devices in use are made of high purity tantalum, there is a high requirement to the devices, thus the corresponding cost being high; 2, because the method is lack of the deoxygenation step, the oxygen content of the resultant product is variable, being markedly different from each other, and thus it is difficult that all the oxygen contents are lower than 1000 ppm; 3. because of the use of the classification treatment, the utilization rate of materials is greatly reduced, and the refinement of the particle size of tantalum powder is difficult.

At present, the production process for metallurgical-grade tantalum powder is generally performed by way of simultaneous dehydrogenation and deoxygenation, and this will lead to limitations to designed process parameters. In particular, if a too low temperature is set, the low temperature will result in incomplete dehydrogenation and a too high hydrogen content in the final product, and at the same time, variations on the properties (such as lattice parameter, resistance, hardness, etc.) of tantalum after hydrogen absorption are not completely eliminated. If a too high temperature is set, the hydrogen gas can be fully released, whereas the too high temperature will result in that the sintered tantalum particles will grow up and that magnesium or magnesium oxide particles are encapsulated in the interior of tantalum particle so that magnesium are difficult to be removed in a subsequent pickling process, thereby resulting in a poor controllability of the particle size. That is, it is very difficult to achieve that while the oxygen content is lower than 1000 ppm, the requirement of the average particle size D50<25 μm can be assured. More unfortunately, the too high temperature will lead to a too high magnesium content. Further, in current processes, after deoxygenation and dehydrogenation, tantalum powder is subjected to pickling, baking to dry, and sieving to give the final product, without any subsequent treatments, which can result in that residual metal magnesium after the deoxygenation, and H, F impurities entrained during the pickling cannot be removed. Thus, the contents of magnesium, hydrogen and the like in the final product are too high.

Clearly, existing technologies can hardly meet retirements on the sputtered film in semiconductor technology.

Directed to the defects present in the above methods, the present invention is proposed.

SUMMARY

The present invention provides a high purity tantalum powder having a purity of greater than 99.995% as analyzed by GDMS, preferably more than 99.999%.

In a preferred embodiment of the present invention, the tantalum powder also has low oxygen, nitrogen, hydrogen, and magnesium contents, e.g., the oxygen content of not more than 1000 ppm, the nitrogen content of not more than 50 ppm, preferably not more than 40 ppm, the hydrogen content of not more than 20 ppm, preferably not more than 15 ppm, and more preferably not more than 10 ppm, and the magnesium content of not more than 5 ppm.

In a preferred embodiment of the present invention, the tantalum powder has a particle size D50<25 μm, and preferably D50<20 μm.

In addition to the sputtered film in semiconductor technology, the tantalum powder can be used for other applications, for example, medical applications, surface spray coating and the like.

The present invention further provides a method for preparing the tantalum powder, which comprises the following steps in turn:

1) Subjecting a high purity tantalum ingot to a hydrogenation treatment;

2) Crushing and sieving the tantalum scraps as prepared after the hydrogenation of the tantalum ingot to tantalum powder, and then purifying the powder by pickling to remove impurity contaminations introduced during ball milling;

3) Subjecting the tantalum powder obtained in the step 2) to a high-temperature dehydrogenation treatment;

4) Subjecting the tantalum powder obtained in the step 3) to a deoxygenation treatment;

5) Subjecting the tantalum powder obtained in the step 4) to pickling, washing, baking to dry, and sieving; and 6) Subjecting the tantalum powder obtained in the step 5) to a low-temperature heat treatment, and then subjecting the treated tantalum powder to cooling, passivating, discharging, and sieving to give the finished product.

As used herein, the high purity tantalum ingot refers to a tantalum ingot having a tantalum content of more than 99.995%. At present, a plurality of methods can be used to obtain such a tantalum ingot, and for example, tantalum ingots are obtained by high-temperature sintering to remove impurity and electron bombardment to remove impurity with tantalum powder as produced by a variety of processes as the raw material. These ingots are also commercially available.

There is no limitation to the crushing means of hydrogenated tantalum scraps, and for example, the crushing can be performed by a gas stream crushing device or a ball milling device. However, it is preferred that all crushed tantalum powder can pass through a 400-mesh sieve, or sieves having higher meshes, for example, 500-, 600-, and 700-mesh. The higher the screen mesh, the finer tantalum powder. However, if tantalum powder is too fine, e.g., less than 700-mesh, it is difficult to control the oxygen content of the tantalum powder. Thus, the sieving in step 2) is preferably meant to pass through a 400- to 700-mesh sieve. For the purpose of illustration but not limitation, in the embodiments of the present invention a ball mill crushing is employed.

Unlike low-temperature dehydrogenation used for energy conservation in the art, the high-temperature dehydrogenation in the invention is preferably carried out as follows: tantalum powder is heated in an inert gas at about 800-1000° C. (such as about 900° C., about 950° C., about 980° C., about 850° C., about 880° C.) and the temperature is kept for about 60-300 minutes (suCh as about 120 minutes, about 150 minutes, about 240 minutes, about 200 minutes); following this, the tantalum powder is subjected to cooling, discharging, and sieving to give dehydrogenated tantalum powder. Surprisingly, the inventors have found that the use of a high temperature for the dehydrogenation can achieve the dehydrogenation while reducing the surface activity of the tantalum powder.

In a preferred embodiment of the present invention, the low-temperature deoxygenation treatment to tantalum powder is carried out in the step 4), i.e., the maximum temperature in the process is preferably not more than the dehydrogenation temperature. So long as a maximum temperature during a general deoxygenation process is lower than the dehydrogenation temperature by about 50-300° C. (such as about 100° C., about 150° C., about 180° C., about 80° C., about 200° C.), the technical effects of accomplishing the dehydrogenation purpose while assuring no sintering and no grow-up of tantalum particles can be achieved, so as to avoid the encapsulation of magnesium or magnesium oxide particles in the interior of the tantalum powder. The encapsulation can result in that the magnesium or magnesium oxide particles may be difficult to be removed during subsequent pickling, so that the magnesium content in the finished tantalum powder is too high.

In a preferred embodiment of the present invention, by adding a reducing agent to the tantalum powder, the deoxygenation is accomplished. Preferably, the deoxygenation is usually carried out in inert gas. In general, the affinity of the reducing agent to oxygen is greater than the affinity of tantalum to oxygen. Examples of such a reducing agent include alkaline earth metals, rare earth metals and their hydrides, in which magnesium powder is most commonly used. As a particularly preferred embodiment, the tantalum powder can be mixed with 0.2-2.0% of metal magnesium powder by weight of the tantalum powder, and the mixture is loaded according to the method as described in Chinese Patent CN 102120258A; the mixture is heated in an inert gas, and it is kept at the temperature of about 600-750° C. (e.g., about 700° C.) for about 2-4 hours. Following this, evacuating is conducted, and on the condition of evacuation, the mixture is kept at the temperature for about 2-4 hours. Then, cooling, passivation, and discharging are carried out to give deoxygenated tantalum powder.

As recognized by the skilled in the art, the heat treatment to tantalum powder is also called as the heat agglomeration, with the main purpose of improving the physical properties of the tantalum powder, increasing the particle size and bulk density of the tantalum powder, and improving the flowability and particle size distribution of the tantalum powder. However, without being bound by general theory, it is believed that the heat treatment of the invention can assure to avoid the increases in the particle size and bulk density of tantalum powder, while further playing more important roles, i.e., for removing residual metal magnesium after the deoxygenation, and impurities such as H, F or the like entrained by the pickling as far as possible. The present invention is carried out in a vacuum treating furnace, and the process requires a high vacuum level. In particular, after the temperature of the heat treatment is higher than about 600° C., the process requires a vacuum level of about $1.0\times10^{-3}$ Pa or higher, and when the temperature of the heat treatment is a low temperature of about 600-1200° C., such as about 800° C., about 950° C., about 1000° C., about 850° C., and about 1100° C., the maximum time period for keeping the temperature in the heat treatment is about 15-90 minutes, e.g., 60 minutes. For example, the heat treatment may be performed according to the method as described in Chinese Patent CN 102120258A.

The advantage of the method according to the present invention resides in the use of the combination of high-temperature dehydrogenation, low-temperature deoxygenation and low-temperature heat treatment. Since tantalum powder feedstock contains hydrides as produced due to the absorption of hydrogen gas, the properties of the tantalum powder (e.g., lattice constant, resistance, hardness) may vary. However, the use of conventional low-temperature dehydrogenation cannot completely eliminate these variations. Without being bound to general theory, the high-temperature dehydrogenation as used here can lead to sufficient release of hydrogen gas, while completely eliminating the variations of the properties of tantalum, so that the tantalum powder can restore to its initial state. Low-temperature deoxygenation is aimed to avoid the sintering and grow-up of the particles as caused by too high deoxygenation temperature.

The inventors surprisingly find out that the uses of the above high-temperature dehydrogenation, low-temperature deoxygenation and low-temperature heat treatment, can avoid the sintering and grow-up of tantalum powder as brought by too high temperature in conventional processes (in which dehydrogenation and deoxygenation are carried out simultaneously), thus may avoid encapsulating magnesium or magnesium oxide particles in the interior of tantalum particles, which can lead to poor controllability of the particle size and too high magnesium content of final product, and can avoid the defect regarding to too high hydrogen content as caused by incomplete dehydrogenation due to a too low temperature. Low-temperature heat treatment is mainly aimed to remove residual metal magnesium after the deoxygenation, and impurities such as H, F or the like entrained during the pickling, while assuring no grow-up of the particles. Thus, while the particle size meets the relevant requirements, the contents of impurities can be well controlled. Finally, the method of the present invention can produce high-purity tantalum powder having a purity of greater than 99.995%, as analyzed according to GDMS.

SPECIFIC MODES FOR CARRYING OUT THE INVENTION

For the purpose of illustration but not limitation, the following examples are provided.

In each embodiment, tantalum powder obtained by the process of reducing potassium ftuotantalate with sodium is used as the raw material (referred to as "sodium reduced tantalum powder"). However, it should be understood that tantalum powder obtained by other processes also can achieve the object of the present invention.

As appreciated by the skilled in the art, the term "bar-compressing" described as follow is meant to compress or press the tantalum powder into tantalum bar by the means of static pressure.

Example 1

Sodium reduced tantalum powder was selected as the raw material, which was subjected to bar-compressing, sintering, and electron beam melting to give a tantalum ingot, and the tantalum ingot was subjected to a hydrogenation treatment. Tantalum scraps obtained after the hydrogenation of the tantalum ingot were crushed by the means of ball milling, and sieved with a 500-mesh sieve. The tantalum powder obtained after the ball milling and the sieving was pickled with a mixed acid of $HNO_3$ and HF ($HNO_3$, HF and water were mixed in a volume ratio of 4:1:20) to remove metal impurities, and following this, the tantalum powder was baked to dry and sieved. The tantalum powder was placed in a closed furnace and heated while charging argon gas to 900° C., and the temperature was kept for 180 minutes. Following this, the tantalum powder was cooled, then discharged and sieved. After the sieving, the tantalum powder was analyzed for the oxygen content, and the result was shown in Table 1. Subsequently, tantalum powder was mixed with magnesium powder in an amount of 1% by weight of the tantalum powder. The mixture was then heated while charging argon gas to 700° C. in a closed furnace, and the temperature was kept for 2 hours. The mixture was then cooled and discharged. The resultant tantalum powder was washed with nitric acid to remove redundant magnesium and magnesium oxide, then washed with deionic water to neutral, and the tantalum powder was baked to dry and sieved. Further, the above tantalum powder was heated under the vacuum of $10^{-3}$ Pa to 700° C., and the temperature was kept for 60 minutes. Following this, the tantalum powder was cooled, passivated, discharged, and sieved to give the sample A. The obtained product was analyzed with a Glow Discharge Mass Spectrometry (GDMS) and its particle size was measured with a Malvern laser particle size analyzer, and the results were shown in Table 1.

Example 2

Sodium reduced tantalum powder was selected as the raw material, which was subjected to bar-compressing, sintering, and electron beam melting to give a tantalum ingot, and the tantalum ingot was subjected to a hydrogenation treatment. Tantalum scraps obtained after the hydrogenation of the tantalum ingot were crushed by the means of ball milling, and sieved with a 500-mesh sieve. The tantalum powder obtained after the ball milling and the sieving was pickled with a mixed acid of $HNO_3$ and HF ($HNO_3$, HF and water were mixed in a volume ratio of 4:1:20) to remove metal impurities, and following this, the tantalum powder was baked to dry and sieved. The tantalum powder was placed in a closed furnace and heated while charging argon gas to 900° C., and the temperature was kept for 180 minutes. Following this, the tantalum powder was cooled, then discharged and sieved. After the sieving, the tantalum powder was analyzed for the oxygen content, and the result was shown in Table 1. Subsequently, tantalum powder was mixed with magnesium powder in an amount of 1% by weight of the tantalum powder. The mixture was then heated while charging argon gas to 750° C. in a closed furnace, and the temperature was kept for 2 hours. The mixture was then cooled and discharged. The resultant tantalum powder was washed with nitric acid to remove redundant magnesium and magnesium oxide, then washed with deionic water to neutral, and the tantalum powder was baked to dry and sieved. Further, the above tantalum powder was heated under the vacuum of $10^{-3}$ Pa to 800° C., and the temperature was kept for 60 minutes. Following this, the tantalum powder was cooled, passivated, discharged, and sieved to give the sample B. The obtained product was analyzed with a Glow Discharge Mass Spectrometry (GDMS) and its particle size was measured with a Malvern laser particle size analyzer, and the results were shown in Table 1.

Example 3

Sodium reduced tantalum powder was selected as the raw material, which was subjected to bar-compressing, sintering, and electron beam melting to give a tantalum ingot, and the tantalum ingot was subjected to a hydrogenation treatment. Tantalum scraps obtained after the hydrogenation of the tantalum ingot were crushed by the means of ball milling, and sieved with a 500-mesh sieve. The tantalum powder obtained after the ball milling and the sieving was pickled with a mixed acid of $HNO_3$ and HF ($HNO_3$, HF and water were mixed in a volume ratio of 4:1:20) to remove metal impurities, and following this, the tantalum powder was baked to dry and sieved. The tantalum powder was placed in a closed furnace and heated while charging argon gas to 900° C., and the temperature was kept for 180 minutes. Following this, the tantalum powder was cooled, then discharged and sieved. After the sieving, the tantalum powder was analyzed for the oxygen content, and the result was shown in Table 1. Subsequently, tantalum powder was mixed with magnesium powder in an amount of 1% by weight of the tantalum powder. The mixture was then heated while charging argon gas to 700° C. in a closed furnace, and the temperature was kept for 2 hours. The mixture was then cooled and discharged. The resultant tantalum powder was washed with nitric acid to remove redundant magnesium and magnesium oxide, then washed with deionic water to neutral, and the tantalum powder was baked to dry and sieved. Further, the above tantalum powder was heated under the vacuum of $10^{-3}$ Pa to 1100° C., and the temperature was kept for 30 minutes. Following this, the tantalum powder was cooled, passivated, discharged, and sieved to give the sample C. The obtained product was analyzed with a Glow Discharge Mass Spectrometry (GDMS) and its particle size was measured with a Malvern laser particle size analyzer, and the results were shown in Table 1.

Comparative Example

Sodium reduced tantalum powder was selected as the raw material, which was subjected to bar-compressing, sintering, and electron beam melting to give a tantalum ingot, and the tantalum ingot was subjected to a hydrogenation treatment. Tantalum scraps obtained after the hydrogenation of the tantalum ingot were crushed by the means of ball milling, and sieved with a 500-mesh sieve. The tantalum powder obtained after the ball milling and the sieving was pickled with a mixed acid of $HNO_3$ and HF ($HNO_3$, HF and water were mixed in a volume ratio of 4:1:20) to remove metal impurities, and following this, the tantalum powder was baked to dry and sieved. The above tantalum powder was mixed with magnesium powder in an amount of 1% by weight of the tantalum powder. Then, the mixture was heated while charging argon gas to 850° C. in a closed furnace, and the temperature was kept for 2 hours. Subsequently, the mixture was cooled and discharged. The resultant tantalum powder was washed with nitric acid to remove redundant magnesium and magnesium oxide, then washed with deionic water to neutral, and the tantalum powder was baked to dry and sieved to give the sample D. The obtained product was analyzed with a Glow Discharge Mass Spectrometry (GDMS) and its particle size was measured with a Malvern laser particle size analyzer, and the results were shown in Table 1.

TABLE 1

Performance Comparison of tantalum powder

| Serial number | Before the deoxygenation O (ppm) | After the deoxygenation O (ppm) | N (ppm) | H (ppm) | Mg (ppm) | Purity (%) | Particle size D50 μm |
|---|---|---|---|---|---|---|---|
| A | 1280 | 650 | 30 | 10 | 1.2 | >99.999 | 10.425 |
| B | 950 | 450 | 35 | 10 | 0.8 | >99.999 | 13.05 |
| C | 1300 | 700 | 30 | 10 | 0.12 | >99.999 | 15.17 |
| D | — | 1200 | 36 | 70 | 33 | 99.992 | 13.49 |

As seen from the above data, the tantalum powder which is treated by the method of the invention had a particle size D50<25 μm, and a purity of at least 99.999%.

The analytical devices and types for each parameter in the present application are shown in the following table:

| Analytic items | Analysis device name | Specification | Manufacturer |
|---|---|---|---|
| Average particle diameter (μm) | Malvern laser particle size analyzer | Mastersizer 2000 | British Malvern Instruments Ltd. |

-continued

| Analytic items | Analysis device name | Specification | Manufacturer |
|---|---|---|---|
| O, N, H | Oxygen and nitrogen analyzer | LECO CS-436 | LECO Corporation |
| Mg (ppm)/Purity | Glow discharge mass spectrometer | Element GD | Thermo Fisher Scientific |

What is claimed is:

1. A high purity tantalum powder having a purity of greater than 99.995%, as analyzed by Glow Discharge Mass Spectrometry (GDMS);

the tantalum powder having an oxygen content of not more than 1000 ppm, and a magnesium content of not more than 5 ppm, and the tantalum powder having a particle diameter D50<25 μm, wherein the high purity tantalum powder is prepared by a method comprising the following steps in sequence:

1) subjecting a high purity tantalum ingot to a hydrogenation treatment;

2) crushing the tantalum scraps as prepared after the hydrogenation of the tantalum ingot to tantalum powder, and then purifying the powder by pickling to remove impurity contaminations introduced during ball milling;

3) subjecting the tantalum powder obtained in step 2) to a high-temperature dehydrogenation treatment, wherein the high-temperature dehydrogenation is carried out as follows:

tantalum powder is heated at about 800-1000° C. and maintained at this temperature for about 60-300 minutes, cooling the tantalum powder;

discharging; and sieving to produce a dehydrogenated tantalum powder;

4) subjecting the tantalum powder obtained in step 3) to a deoxygenation treatment, wherein the deoxygenation temperature is lower than the dehydrogenation temperature by a temperature within the range of from 50-300° C.;

5) subjecting the tantalum powder obtained in step 4) to pickling, washing, baking to dry, and sieving; and 6) subjecting the tantalum powder obtained in step 5) to a low-temperature heat treatment performed by maintaining a temperature within the range of 600-1200° C. for about 15-90 minutes, and then subjecting the treated tantalum powder to cooling, passivating, discharging, and sieving to produce the high purity tantalum powder.

2. The high purity tantalum powder of claim 1, wherein the tantalum powder has:

a nitrogen content of not more than 50 ppm, preferably not more than 40 ppm; and a hydrogen content of not more than 20 ppm, preferably not more than 10 ppm.

3. The high purity tantalum powder of claim 1, wherein the tantalum powder has a particle diameter D50<20 μm.

4. The high purity tantalum powder of claim 1, wherein the high-temperature dehydrogenation of step 3) is carried out as follows:

tantalum powder is heated at about 900-950° C. and the temperature is maintained for about 60-300 minutes; and the tantalum powder is then subjected to cooling, discharging, and sieving operations to achieve the dehydrogenated tantalum powder.

5. The high purity tantalum powder of claim 1, wherein the deoxygenation temperature is lower than the dehydrogenation temperature by about 80-200° C.

6. The high purity tantalum powder of claim 1, wherein said low-temperature heat treatment is performed by maintaining the temperature of about 600-1200° C. for about 60 minutes, and at a vacuum level of $10^{-3}$ Pa or higher.

7. The high purity tantalum powder of claim 1, wherein the tantalum scraps are crushed in step 2) to a level that the resultant powder can pass through 400-700-mesh sieves.

8. A method of using the high purity tantalum powder of claim 1 in semiconductor, medical and/or surface spray coating applications.

* * * * *